United States Patent [19]

Howes

[11] Patent Number: 4,508,489

[45] Date of Patent: Apr. 2, 1985

[54] FUEL INJECTION PUMPS

[75] Inventor: Peter Howes, Gerrards Cross, England

[73] Assignee: Lucas Industries public limited company, Birmingham, England

[21] Appl. No.: 563,377

[22] Filed: Dec. 20, 1983

[30] Foreign Application Priority Data

Jan. 11, 1983 [GB] United Kingdom ..... 8300638

[51] Int. Cl.[3] ..... F04B 19/02; F04B 49/00; F02M 59/20

[52] U.S. Cl. ..... 417/221; 417/462; 123/502

[58] Field of Search ..... 417/218, 221, 462; 123/450, 501, 502

[56] References Cited

U.S. PATENT DOCUMENTS

| | | | |
|---|---|---|---|
| 2,910,975 | 11/1959 | Evans | 417/462 X |
| 3,101,078 | 8/1963 | Evans | 417/462 |
| 3,811,799 | 5/1974 | Jackson | 417/221 |
| 4,050,432 | 9/1977 | Davis et al. | 123/502 X |
| 4,050,433 | 9/1977 | Tokashiki | 123/502 |
| 4,074,667 | 2/1978 | Skinner | 417/462 X |
| 4,224,916 | 9/1980 | Davis | 123/502 |
| 4,333,437 | 6/1982 | Lohner et al. | 123/502 |
| 4,359,995 | 11/1982 | Mowbray | 123/502 |
| 4,384,562 | 5/1983 | Hammock | 123/502 |
| 4,387,688 | 6/1983 | Eheim | 123/502 |
| 4,406,268 | 9/1983 | Eheim et al. | 123/502 |
| 4,419,054 | 12/1983 | Sosnowski et al. | 417/221 X |
| 4,432,327 | 2/1984 | Salzgeber | 123/502 |

FOREIGN PATENT DOCUMENTS

| | | | |
|---|---|---|---|
| 2069722 | 8/1981 | United Kingdom | 123/502 |
| 254956 | 1/1973 | U.S.S.R. | 123/501 |

*Primary Examiner*—William L. Freeh
*Assistant Examiner*—Paul F. Neils

[57] ABSTRACT

A fuel injection pump of the rotary distributor type includes a cam actuated plunger housing in a bore and an adjustable fuel control member which varies the amount of fuel supplied to the bore. The pump also includes a timing piston connected to the cam, the piston being biased by a spring against the action of fuel under pressure. In order to vary the timing under certain conditions a control piston serves as an abutment for the spring and the application of pressure to the control piston is controlled by a valve which has a valve element coupled to a throttle member of the pump the valve having a housing which is secured on the exterior of the pump.

2 Claims, 7 Drawing Figures

FUEL INJECTION PUMPS

This invention relates to rotary distributor type fuel injection pumps for supplying fuel to compression ignition engines and of the kind including a pumping plunger slidable in a bore, a cam for effecting inward movement of the plunger thereby to displace fuel from the bore to an outlet, throttle means for controlling the admission of fuel to the bore, said throttle means including an angularly adjustable throttle member, a fluid pressure operable timing piston coupled to said cam for varying the timing of fuel delivery by the pump through said outlet, a fluid pressure operable control piston which in its operative position has the effect at least at low engine speeds, of causing said timing piston to effect advance of the timing of fuel delivery, valve means for controlling the application of fluid pressure to said control piston, governor means for controlling the setting of said throttle member, said governor means comprising a centrifugal weight which is driven at a speed proportional to the speed of the associated engine, a linkage connecting said weight to said throttle means so that as the weight moves with increasing speed the throttle member will be moved to reduce the amount of fuel supplied to said bore, resilient means connected to said linkage and acting to oppose the movement of the weight as the speed of the associated engine increases, and operator adjustable means for adjusting the force exerted by said resilient means.

With the kind of pump set forth the timing of delivery of fuel becomes more and more retarded as the quantity of fuel delivered is decreased. This is because the plunger, as the fuel quantity becomes smaller, engages the cam later. This type of characteristic has advantages particularly with indirect injection engines, namely the reduction of noise and also smoke at engine part load operation. However, in order to reduce the level of noxious gases in the engine exhaust when the engine is operated at full load, it is necessary to retard the timing as against that which would be obtained. The result is that for engine light load conditions the timing is too retarded for proper combustion of the fuel to take place. It is therefore necessary to provide some form of arrangement which has the effect of correcting the timing at light engine loading.

The object of the present invention is to provide a pump of the aforesaid kind in an improved form.

According to the invention in a pump of the kind specified the valve means comprises a housing part adapted to be secured to the exterior of the pump housing, a valve element movable in said housing part and an arm connected to said valve element, said arm projecting into the pump housing and engaging with a part of said linkage whereby the application of fluid pressure to said control piston will depend upon the setting of said throttle member.

Figure 1:
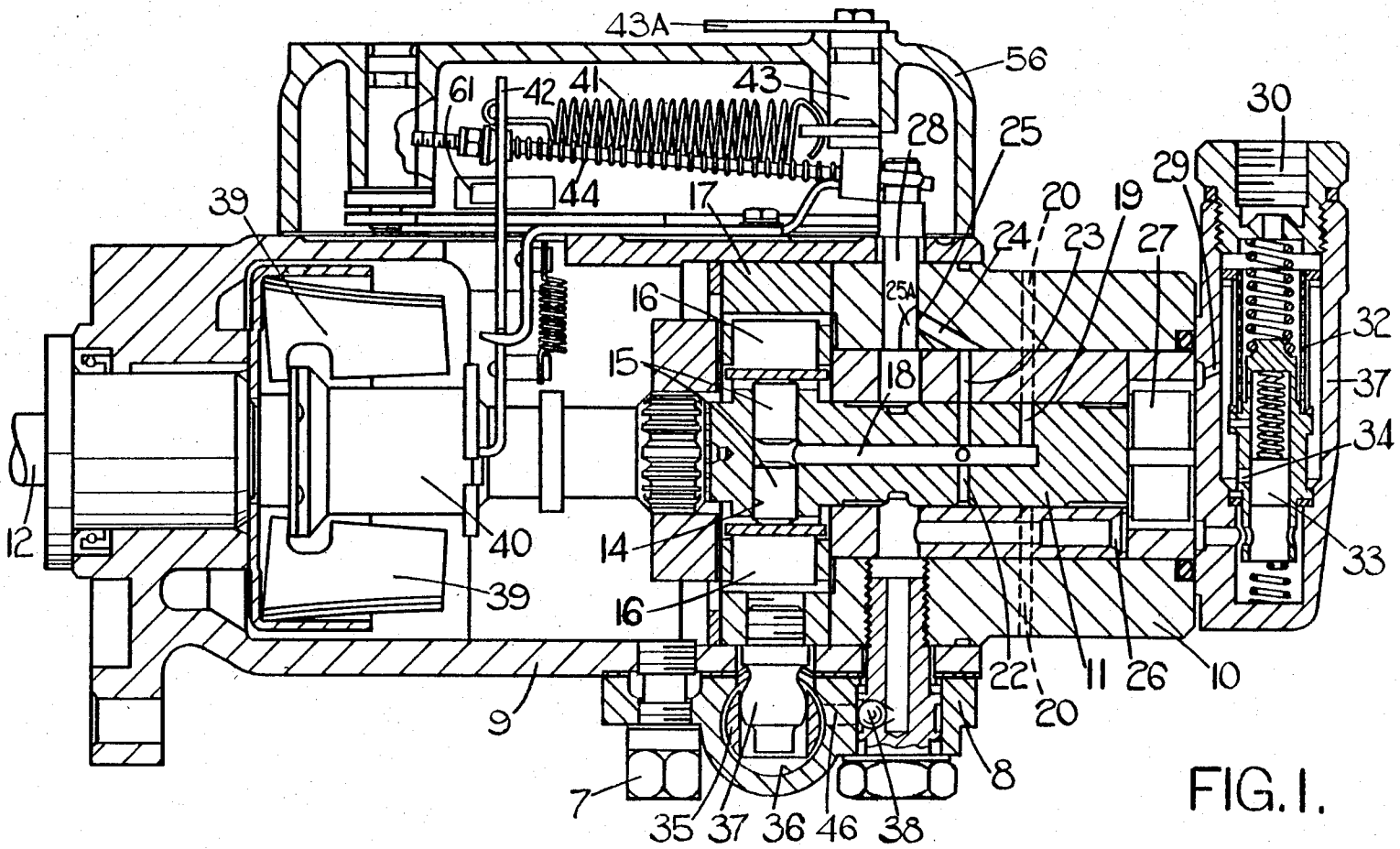
Figure 2:
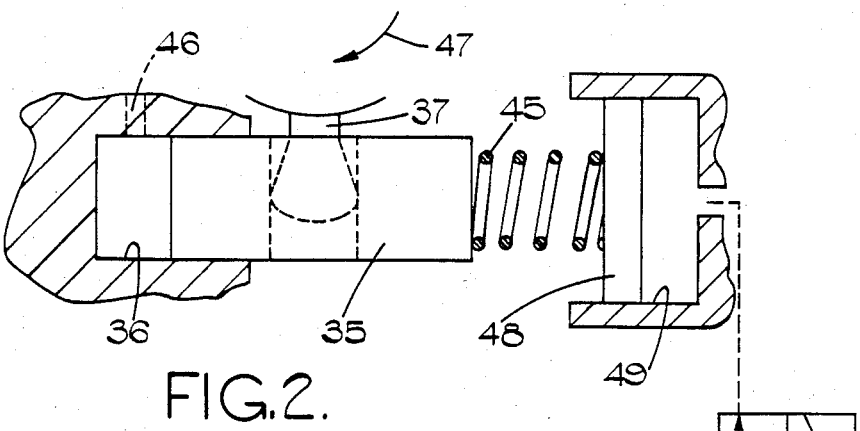
Figure 3:
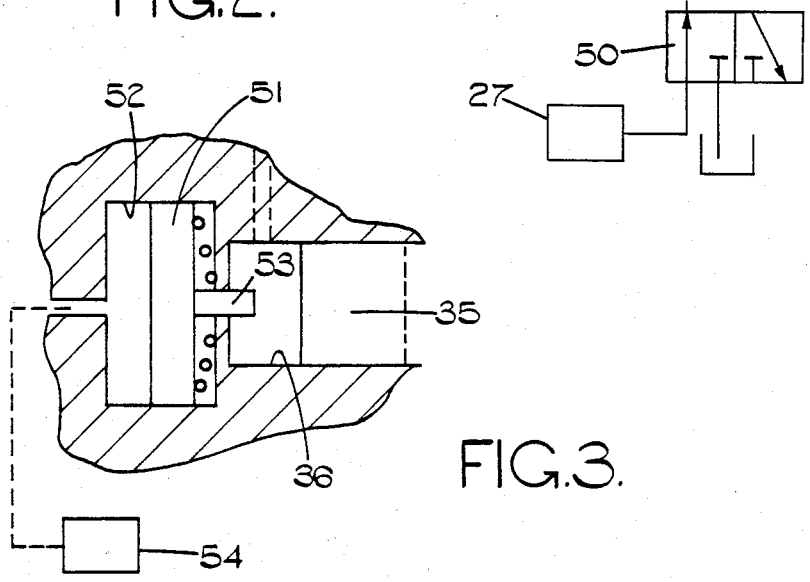
Figure 4:
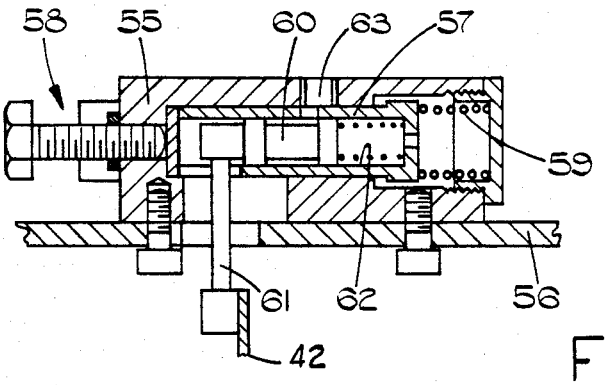
Figure 5:
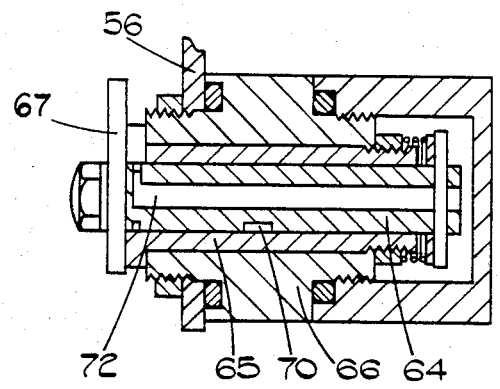
Figure 6:
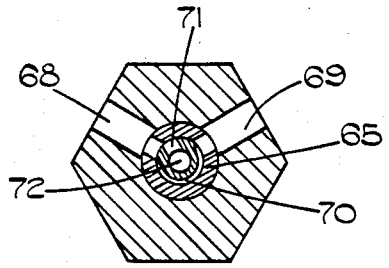
Figure 7:
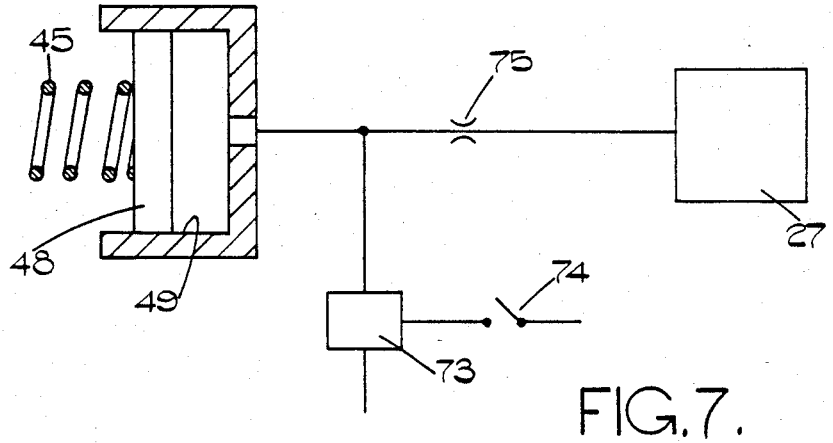

In the accompanying drawings:

FIG. 1 is a part sectional side elevation of one form of pump to which the invention may be applied, FIG. 2 is a part sectional end view of a portion of the pump seen in FIG. 1 incorporating one example of the invention, FIG. 3 is a modified form of the portions of the pump seen in FIG. 2, FIG. 4 shows a sectional side elevation of an another example of a valve for use in the pump, FIGS. 5 and 6 show a sectional side elevation, and a section of another example of a valve, and FIG. 7 shows a further arrangement.

Referring to FIG. 1 of the drawings the pump comprises a body 10 in which is mounted a rotary cylindrical distributor member 11. The distributor member is coupled to an output shaft 12 which in use is driven by a rotary part of the associated engine. Formed within the distributor member is a transverse bore 14 in which is located a pair of reciprocable pumping plungers 15. The plungers 15 are arranged to be moved inwardly as the distributor member rotates, by means of cam followers including rollers 16, engageable with cam lobes formed on the internal peripheral surface of an annular cam ring 17 which is mounted for angular movement within the body 10.

Formed in the distributor member is a longitudinally extending passage 18 which at one end communicates with the bore 14 and at its other end, communicates with a radially disposed delivery passage 19. The delivery passage is arranged to register in turn with a plurality of equi-angularly spaced outlets 20 which in use, are connected to the injection nozzles respectively of the associated engine. The registration of the passage 19 with one of the outlets 20 takes place during the whole time the plungers 15 are capable of being moved inwardly so that liquid fuel contained within the bore 14 will be displaced to a combustion space of the associated engine.

At another point the longitudinal passage 18 communicates with a plurality of equi-angularly spaced inlet passages 22 which are arranged to register in turn with an inlet port 23 formed in the housing and in communication with a control port 25 by way of a passage 24. The control port 25 communicates with the outlet 26 of a low pressure feed pump 27 by way of a slot formed in an angularly adjustable throttle member 28. By adjusting the angular setting of the throttle member, the effective size of the control port 25 is varied so that when an inlet passage 22 is in register with the inlet port 24, the amount of fuel which is supplied to the bore 14 can be controlled. The registration of an inlet passage 22 with the inlet port 23 takes place during the time when the delivery passage 19 is out of register with an outlet and when the rollers are clear of the cam lobes. The angular setting of the throttle member 28 therefore varies the amount of fuel which is supplied to the associated engine.

The low pressure feed pump 27 is provided with an inlet which is in communication with an inlet port 30 formed in a hollow part 37 mounted on the housing 10. The inlet 30 communicates with the fuel inlet of the low pressure pump 27 by way of a passage 29 and a tubular fuel filter element 32 is provided to filter the fuel flowing to the pump inlet. The part 37 also houses a relief valve in the form of spring loaded plunger 33 one end of which is exposed to the output pressure of the low pressure pump so that the size of a spill port 34 is controlled. The low pressure pump 27 always delivers more fuel than is required for supply to the engine and since the element 33 is spring-loaded, the output pressure of the low pressure pump varies in accordance with the speed at which the pump is operated.

The cam ring 17 as mentioned, is angularly adjustable so that the timing of delivery of fuel to the engine can be modified. The adjustment of the cam ring is achieved by means of a piston 35 which is mounted in a cylinder 36 and a peg 37, coupled to the cam ring is located within an aperture in the piston 35 to convert axial movement of the piston within its cylinder to angular movement of the cam ring.

The angular setting of the throttle valve 28 is conveniently controlled by a mechanical governor means which includes weights 39 accommodated within a cage driven by the shaft 12. The weights are coupled by a linkage to the throttle member 28. The weights engage an axially movable collar 40 slidable upon the drive shaft and the collar bears against one end of a lever 42 the other end of which is coupled to one end of a coiled tension spring 41. The other end of the tension spring is connected to a manually operable member 43 which in the case where the engine is for driving a vehicle would be coupled to the throttle pedal of the vehicle. The other end of the lever is also connected by means of a tie rod 44, to a radial arm mounted on the throttle member 28.

As shown in FIG. 1 the governor mechanism is what is known in the art as an "all speed" governor and for a given setting of the angularly adjustable member 43, as the speed of the associated engine increases, the weights will move outwardly against the action of the force exerted by the spring 41. In so doing, the lever 42 pivots and the throttle member 28 is moved to reduce the supply of fuel to the engine. The position of the throttle member is indicative of the amount of fuel being supplied to the engine. It will be appreciated that the governor mechanism illustrated does not show an idling spring which would be provided specifically for controlling the engine idling speed in both forms of governor.

As shown in FIG. 2, the piston 35 is biased by a coiled compression spring 45, against the action of fuel under pressure applied to the piston through a passage 46 which is connected to the outlet 26 of the low pressure pump 27 by way of a check valve 38. The direction of rotation of the distributor member is indicated by the arrow 47 in FIG. 2 and it will be seen that as the output pressure of the pump 27 increases with speed, the piston 35 will move against the action of the spring 45 in a direction to advance the timing of delivery of fuel to the associated engine. As previously explained however for a given speed, as the amount of fuel supplied by the pump decreases, the timing of the delivery of fuel becomes more and more retarded and as the quantity of fuel delivered by the apparatus is increased, the timing becomes more and more advanced. If the various components are set to produce the correct timing when the amount of fuel supplied to the engine is at its maximum, the timing is too retarded when the quantity of fuel supplied to the engine is small, for satisfactory combustion of the fuel to take place.

In order to modify the timing at low engine loads a control piston 48 is provided and this is slidable within a cylinder 49. The piston and cylinder are larger in diameter than the piston 35 and the piston acts as a movable abutment for the spring 45. A valve 50 is provided for controlling the admission of fluid conveniently fuel, under pressure to the cylinder 49. The piston 48 is shown in its inoperative position in FIG. 2 and in order to allow the piston 48 to move to its operative position, the valve 50 must be operated to reduce the pressure of liquid in the cylinder 49. When the pressure in the cylinder 49 is reduced the piston 48 will move under the action of the spring towards its operative position thereby allowing the piston 35 to move to advance the timing of delivery of fuel. Conveniently the valve 50 is a two-way valve possible constructions of which will be described later. The valve 50 must be coupled with the throttle member 28. It should be noted that in this example the advancement of the timing of fuel delivery for low engine loads is effected throughout the full range of engine speed.

In the arrangement which is shown in FIG. 3, the piston 35 is again spring biased against the action of fuel pressure in the cylinder 36 but in this case a control piston 51 housed within a cylinder 52, mounts an abutment 53 which projects into the end of the cylinder 36 remote from the spring which biases the piston 35. In its operative position as shown, the abutment 53 projects into the cylinder 36 so that when the engine speed is low the piston 35 will be held against movement to its fully retarded position. A normal advance characteristic will be obtained with this arrangement when the output pressure of the low pressure pump is sufficient to move the piston 35 against the action of its spring, out of contact with the abutment 53. The movement of the control piston 51 to its operative position is achieved by applying liquid under pressure to the cylinder 52, the supply of liquid under pressure being controlled by a valve 54 which must operate in the reverse manner to the valve 50. The valve 54 as with the valve 50 is coupled with the throttle member 28.

The valve which is shown in FIG. 4 comprises a housing part 55 which is adapted to be secured by means of bolts to an enclosure 56 (FIG. 1) which encloses the spring 41 and associated parts. Slidable in the housing part 55 is a sleeve 57 which is biased into contact with an adjustable abutment 58 by means of a coiled spring 59. Moreover slidable within the sleeve is a spool valve element 60 to which is secured an arm 61 which extends laterally through an elongated aperture in the sleeve 57 and an elongated aperture in the enclosure 56. The arm extends into engagement with the lever 42 of the governor mechanism, the position of the lever 42 being representative of the position of the throttle member 28 since it is coupled thereto by the rod 44. The spool is biased by a light spring 62 which engages against an end cap of the sleeve.

The spool valve element 60 has a pair of spaced lands and the annular space defined between the lands and the wall of the sleeve is in permanent communication with, in the case of the example of FIG. 2, the cylinder 49, through a port not shown. A port 63 opens into the wall of the sleeve and communicates with the outlet 26 of the low pressure pump. In the position shown the port 63 is in communication with the aforesaid annular space and therefore with the cylinder 49 so that the piston 48 is moved to the position in which it is shown in FIG. 2. As the spool valve element is moved towards the left, the port 63 is obturated by the right hand land and the space between the lands is placed in communication with the interior of the casing, by the fact that the other land uncovers the space to the slot through which the arm 61 extends. The effective position of the port 63 in relation to the spool valve element, can be adjusted by means of the abutment 58.

The valve which is shown in FIGS. 5 and 6 is of the rotary type, and it comprises a valve element 64 located within a sleeve 65 carried in a body 66 adapted to be screwed into a threaded bore in the enclosure 56. The valve element 64 has an arm 67 connected thereto for engagement with the lever 42 in such a manner that as the lever pivots, angular movement will be imparted to the valve element. The valve body and sleeve define ports 68, 69 for connection in the case of the pump shown in FIG. 2, to the cylinder 49 and the output 26 of the low pressure pump. The valve element 64 is provided with a part circumferential groove 70 which can place the ports 68 and 69 in communication with each other so as to admit fuel under pressure to the cylinder 49. The remaining portion of the valve member in the radial plane of the groove 70, defines a port 71 which communicates with a central passage 72 formed in the valve member and which is open to the interior of the governor casing. As the valve member is moved to interrupt communication between the grooves 70 and the port 68, the port 71 is brought into register with the port 68 thereby allowing fuel to escape from the cylinder 49.

It is sometimes necessary to modify the timing of fuel delivery as between when the associated engine is hot or cold, throughout the engine speed range.

The apparatus shown in FIGS. 1 and 2 can be used to accomplish this aim but in this case the valve 50 is responsive to the temperature of the associated engine. As is shown in FIG. 7 the valve 73 is an electromagnetic on/off valve controlled by a temperature sensitive switch 74 and the valve is connected between a drain and a point intermediate a restrictor 75 and the cylinder 49, the restrictor connecting with the outlet of the low pressure pump. The valve is arranged to be open when the engine is cold so that the piston 48 under the action of the spring 45 assumes a position at the inner end of its cylinder thereby reducing the force exerted by the spring 45 and allowing the piston 35 to advance the timing over the whole speed range as compared to the situation when the engine is hot and the force exerted by the spring 45 is increased as the piston 48 is moved away from the inner end of the cylinder.

I claim:

1. A rotary distributor type fuel injection pump for supplying fuel to compression ignition engines and including a pumping plunger slidable in a bore, a cam for effecting inward movement of the plunger thereby to displace fuel from the bore to an outlet, throttle means for controlling the admission of fuel to the bore, said throttle means including an angularly adjustable throttle member, a fluid pressure operable timing piston coupled to said cam for varying the timing of fuel delivery by the pump through said outlet, a fluid pressure operable control piston which in its operative position has the effect at least at low engine speeds, of causing said timing piston to effect advance of the timing of fuel delivery, valve means for controlling the application of fluid pressure to said control piston, governor means for controlling the setting of said throttle member, said governor means comprising a centrifugal weight which is driven at a speed proportional to the speed of the associated engine, a linkage connecting said weight to said throttle means so that as the weight moves with increasing speed the throttle member will be moved to reduce the amount of fuel supplied to said bore, resilient means connected to said linkage and acting to oppose the movement of the weight as the speed of the associated engine increases, operator adjustable means for adjusting the force exerted by said resilient means, said valve means comprising a housing part to be secured to the exterior of a pump housing, a sleeve located in the housing part, a spool slidable in said sleeve, a pair of lands on said spool having an annular space therebetween in communication with said control piston, a pair of ports in said sleeve, said ports and annular space being connected in a flow path to said control piston, one of said lands during movement of the spool in one direction closing said flow path, and an arm connected to said spool, said arm projecting into the pump housing and engaging with a part of said linkage, whereby the application of fluid pressure to said control piston will depend upon the setting of said throttle member.

2. A pump according to claim 1 in which said sleeve is axially adjustable within said housing part.

* * * * *